US007293622B1

(12) United States Patent
Spital

(10) Patent No.: US 7,293,622 B1
(45) Date of Patent: Nov. 13, 2007

(54) FOOT-CONTROLLED MOTORIZED VEHICLE

(76) Inventor: Wade Spital, 728 H St., Petaluma, CA (US) 94952

( * ) Notice: Subject to any disclaimer, the term of this patent is extended or adjusted under 35 U.S.C. 154(b) by 0 days.

(21) Appl. No.: 10/765,437

(22) Filed: Jan. 26, 2004

Related U.S. Application Data

(60) Provisional application No. 60/442,367, filed on Jan. 25, 2003.

(51) Int. Cl.
*A63C 17/12* (2006.01)

(52) U.S. Cl. ..... 180/181; 180/180; 180/65.1; 280/87.01

(58) Field of Classification Search ..... 180/180, 180/181, 65.1, 171; 280/87.041, 87.042, 280/87.043, 87.021, 87.01
See application file for complete search history.

(56) References Cited

U.S. PATENT DOCUMENTS 3,751,062 A * 8/1973 White, Sr. ..... 280/87.042
4,151,892 A 5/1979 Francken
5,020,621 A * 6/1991 Martin ..... 180/181
5,487,441 A 1/1996 Endo et al.
6,050,357 A 4/2000 Staelin et al.
6,193,249 B1 * 2/2001 Buscaglia ..... 280/87.042
6,199,880 B1 * 3/2001 Favorito et al. ..... 280/87.042
2001/0032743 A1 * 10/2001 Kamen et al. ..... 180/7.1

OTHER PUBLICATIONS

Segway™ Human Transporter Dynamic Stabilization, Article from www.segway.com.

* cited by examiner

*Primary Examiner*—Christopher P. Ellis
*Assistant Examiner*—John D Walters
(74) *Attorney, Agent, or Firm*—Patent Law Offices of MEW

(57) ABSTRACT

A weight-controlled, motorized vehicle can be accelerated in either direction, steered, or decelerated without hand controls and without repositioning of a rider situated atop the vehicle. Like a skateboard, the vehicle is normally ridden by a rider standing upon a platform on top of the vehicle with one foot in front of the other. The vehicle is propelled forward when the rider increases weight on the front portion of the platform and backward when weight is increased on the rear portion. The vehicle is steered like a skateboard, by tilting the platform from side-to-side. An improved drive system utilizes a single front drive wheel to power and steer the vehicle. The drive system eliminates need of a flexible power transmission coupling such as a U-joint or constant-velocity joint. It also eliminates need of the differential mechanism normally required for two laterally spaced drive wheels.

26 Claims, 10 Drawing Sheets

FOOT-CONTROLLED MOTORIZED VEHICLE

CROSS-REFERENCE TO RELATED APPLICATIONS

This invention claims benefit of PPA Ser. No. 60/442,367 filed Jan. 25, 2003

FEDERALLY SPONSORED RESEARCH

NONE

SEQUENCE LISTING

NONE

BACKGROUND OF THE INVENTION

1. Field of Invention

This invention relates to personal motorized vehicles, specifically to a motorized, skateboard-like vehicle whose speed and direction can be controlled entirely by the feet of its rider.

2. Description of Prior Art

Skateboards

Skateboards have enjoyed popularity in recent years for several reasons. One is that skateboards are relatively simple and inexpensive. Another is that a skateboard can be ridden hands-free which allows the rider's hands to do something else, like carry something. The skateboard's small size also permits it to be stored without difficulty and carried easily when it is not being ridden.

The popularity of skateboards, however, has been limited in part because they are difficult to ride. Propelling a skateboard requires significant balance and coordination. The rider's weight must supported while the rider steers with one foot and applies a propelling force against the ground with the other foot. It follows that skateboards have not been attractive to non-risk takers or those who feel they might be somewhat uncoordinated.

Skateboards also do not have their own power source, making them unsuitable for non-athletic people or those in dressy or business attire. Furthermore, the small, hard wheels on skateboards make them very difficult to ride on rough or rocky surfaces and largely unsuitable for unpaved surfaces.

Foldable Kick Scooters

Kick scooters have become a practical alternative to riders who may see the skateboard as too difficult or risky to ride. They have handlebars, making them easier to steer and balance. Although not as easy to carry or store as a skateboard, they can be folded when not being ridden. This makes them fairly manageable when not in use.

Kick scooters, however, are not powered and have enjoyed little popularity among teens and adults. They are regarded primarily as toys for children.

Motorized Kick Scooters

The advent of the foldable Kick scooter has given rise to a number of motorized versions. Some of these are electric and others are gasoline-powered. These electric scooters generally feature one or two rechargeable batteries with a 12 or 24 volt DC motor. The speed of these devices is sometimes controlled by a simple on-off finger-operated lever switch. More sophisticated vehicles use a variable speed control mechanism. This is usually a throttle lever or a motorcycle type twistable handgrip. The variable speed versions typically utilize Pulse-Width-Modulated (PWM) electronic motor controllers. PWM motor controllers are used because they make efficient use of the finite power available from the scooter's batteries.

The gasoline-powered versions, often referred to as "Go-peds," are generally powered by small two-stroke internal combustion engines like those used in gas-powered weed cutters and hedge trimmers. Go-peds tend to be faster than the electric versions, but they also create more noise. Go-peds are disfavored in quiet neighborhoods for this reason.

While motorized kick scooters have enjoyed some popularity, they lack some of the advantages of skateboards. They are larger and more difficult to carry and store. They also cannot be ridden hands-free as a skateboard can.

Motorized Skateboards

Individuals have mounted small motors on skateboards to aid in propulsion. There are at least two electric-powered skateboards which are commercially available. Motorized skateboards generally employ a hand-held throttle connected to the drive unit either by cable, wire, or a wireless radio control system.

While interesting, these motorized skateboards have not been particularly popular. One reason for this is they lose one of the conventional skateboard's primary advantages, namely its ability to be ridden hands-free. Motorized skateboards also suffer on rough or rocky surfaces because of their small, hard wheels.

PRIOR ART PATENTS

Other types of foot-controlled motorized vehicles have been proposed. Three relevant patents are discussed below.

U.S. Pat. No. 4,151,892 to Francken (1979) shows a "Motorized Terrestrial Surf-Board" which has two steerable rear wheels and utilizes a gasoline engine for power. While interesting, Francken's vehicle has many serious practical flaws.

First, the size of the board upon which the rider stands covers only a small portion of Francken's vehicle. This severely restricts the rider's ability to place one foot substantially in front of the other when standing on the foot board. It would be essential during acceleration and deceleration to brace oneself on the foot board by standing sideways with feet and legs spread apart. Without this feet-apart sideways stance the vehicle would tend to accelerate out from under, and topple the rider. Similarly, when decelerating or braking, the rider would be thrown forward.

We might reasonably guess that Francken intended his vehicle to be the size of a regular surfboard. By scaling Francken's drawings, one could estimate that if the vehicle is 150 cm long, the foot board would be approximately 80 cm long. Standard skateboards are also about 80 cm long. This suggests that a reasonable feet-apart sideways stance is possible if Francken's vehicle had a foot board that was 80 cm long. Unfortunately, a vehicle that is 150 cm long would be unreasonably large. The vehicle would be extremely cumbersome to operate or carry.

Another problem is that the drive wheels are located toward the center of Francken's vehicle. This means that approaching a small upward slope or negotiating a minor depression in the roadway would sometimes cause the vehicle to "hang up" on its ends. In this case the drive wheels would be unable to contact the ground and achieve needed traction. This problem would be even more severe if the vehicle were the size of a regular surfboard. The longer Francken's vehicle is made, the more severe the problem would be.

The brakes on Francken's vehicle would also be difficult to operate. The rider would have to balance on one foot while moving the other foot to the brake actuator area. Yet removing one foot from the foot board would change the weight balance about the transverse throttle axis. This would change the speed of the motor. The vehicle would accelerate or decelerate at the exact moment that the foot of the rider was lifted! Maintaining one's balance while applying the brakes on this vehicle would be would be difficult at best.

Finally, Francken's vehicle only goes forward. This limits its maneuverability and necessitates dismounting and picking up the vehicle when there is insufficient room to turn.

U.S. Pat. No. 5,487,441 to Endo et al (1996) shows a "Motorized Board With Pressure Actuated Power Switch". This is primarily a standard four-wheeled skateboard with a fifth powered wheel in the middle of the board. This invention suffers from several serious problems. First, having the powered fifth wheel in the center would only work flat surfaces. When starting up a small hill or riding over a minor depression in the roadway the fifth wheel might not be able to reach the ground. It would lose the necessary traction to propel the vehicle forward and be spinning freely in the air. The powered fifth wheel itself could also get hung up on a small mound. This would raise other wheels in the air and render them unable to stabilize or steer the vehicle.

For controlling the motor, Endo shows only a foot-operated momentary on off switch. The rider would have to reposition one foot to turn the motor on or off. This action would be awkward and probably unsafe. Also, with no variable speed throttle, Endo's vehicle could only use a very low power motor. A more powerful motor would render the vehicle far too difficult to control with a simple on-off switch.

U.S. Pat. No. 6,050,357 to Staelin et al (2000) shows a "Powered Skateboard". This is primarily an electric vehicle which has one or more pressure sensors mounted on the board. These sensors interact with an onboard computer and another sensor in the motor to control the vehicle's speed. Staelin discloses numerous elaborate features and modes of operation many of which are technically complex. Although some of these features could possibly be implemented, their cost might preclude their inclusion in a commercially viable product.

Like Francken, Staelin also fails too consider the importance of foot placement to balance and stability for his vehicle. In FIG. 1B he indicates that the rider's feet are placed right next to each other. As previously discussed, it would be difficult for one to safely accelerate or brake when one's feet are so close together.

Compounding this problem, Staelin also shows the front and rear wheels as being very close together. The foot board extends well beyond the wheels in both the forward and backward direction. This would create a tendency for the vehicle to unintentionally tip up on to two wheels (not unlike "popping a wheelie"). This tendency would be especially pronounced during acceleration and deceleration. The short wheelbase of Staelin's vehicle would curtail the rider's ability to safely brace himself by placing one foot substantially in front of the other.

OBJECTS AND ADVANTAGES

Some of the objects and advantages of the present invention are:

(a) to provide a practical and rideable foot-controlled motorized vehicle. This vehicle will be entirely controllable by the feet of a rider without requiring the repositioning of the rider's feet.

(b) to provide an improved propulsion system for a vehicle that enjoys many of the skateboard's advantages. These advantages include small size, good maneuverability and hands free operation.

(c) to provide a foot-controlled motorized vehicle that allows the rider to place one foot substantially in front of the other whether accelerating or decelerating the vehicle. This will allow the rider to maintain stability and balance during all phases of the vehicle's operation.

(d) to provide vehicle with a rider-supporting platform upon which a rider may stand, sit or kneel. The vehicle will be entirely controllable by the shifting of the rider's weight upon the rider-supporting platform. This will provide an alternative to standing while riding the vehicle. Some will find sitting or kneeling easier and more enjoyable. Sitting or kneeling can also be a way to learn to ride the vehicle. Some may want to practice in this manner and then try standing up.

(e) to provide a foot-controlled motorized vehicle that can negotiate a wide variety of adverse terrains and riding conditions. This will make the vehicle versatile and useful in a broad range of situations and places.

(f) to provide an embodiment of this vehicle that can be accelerated or decelerated in either the forward or reverse direction. Once again, the rider will be able to perform these actions without hand controls and without repositioning either foot. The ability to reverse directions will make the vehicle more dexterous, maneuverable and enjoyable to ride.

(g) to provide an embodiment with only three wheels. This will simplify its manufacture and help to differentiate it from other vehicles on the market.

(h) to provide a simple drive system. The embodiments shown utilize a single front wheel to both power and steer the vehicle. The single front wheel and the drive motor are both mounted to a steerable truck. Power is transmitted by a simple timing belt from the motor to the front wheel. This eliminates the need for a flexible coupling such as a U-joint or a constant-velocity joint. A flexible coupling like this would otherwise be required to transmit power from a chassis-mounted motor to a steerable drive wheel.

(i) to provide a drive system with no need for a differential. A differential is generally required on vehicles which employ laterally paired drive wheels. This is because laterally paired drive wheels must be allowed to rotate at different speeds when the vehicle is turning. A car is a good example of this. When a car goes around a turn, it's differential allows the outer wheel to spin faster than the inner wheel. The one-wheel drive system provided eliminates the need for such a differential.

(j) to provide an embodiment of this invention that has a unique visual appeal. The look of this vehicle will provide a significant marketing advantage. The embodiments shown feature an egg-shaped deck. This egg-shaped deck complements the vehicle's three wheel design and helps differentiate it from other skateboards and scooters.

(k) to provide an embodiment of this invention that it can be powered by an internal combustion engine or an electric motor. This will give the developer greater flexibility in providing a power source for the vehicle.

Even more objects and advantages of this invention will become apparent through consideration of the drawings and the ensuing descriptions thereof.

| FIRST EMBODIMENT REFERENCE NUMERALS (FIGS 1B-7F) | |
|---|---|
| 10 | Deck Assembly |
| 11 | Deck |
| 11G | Deck Grip Tape |
| 11S | Deck Screws (34) |
| 12L | Left Deck Bar |
| 12R | Right Deck Bar |
| 13 | Deck Block |
| 14L | Left Throttle Pivot |
| 14R | Right Throttle Pivot |
| 14S | Throttle Pivot Screws (4) |
| 15F | Front Throttle Dampener |
| 15B | Back Throttle Dampener |
| 20 | Central Rocker Assembly |
| 21 | Central Rocker |
| 22L | Left Throttle Pivot Pin |
| 22R | Right Throttle Pivot Pin |
| 23B | Back Steering Pivot Pin |
| 23F | Front Steering Pivot Pin |
| 24L | Left Front Steering Dampener |
| 24R | Right Front Steering Dampener |
| 25L | Left Rear Steering Dampener |
| 25R | Right Rear Steering Dampener |
| 30 | Throttle Assembly |
| 31 | Throttle Potentiometer Clamp |
| 32 | Throttle Potentiometer |
| 33 | Throttle Finger |
| 34 | Throttle Pin Block |
| 34S | Throttle Pin Block Screws (2) |
| 35 | Throttle Pin |
| 40 | Head Assembly |
| 41 | Head Block |
| 42B | Bottom Head Bearing Cup |
| 42T | Top Head Bearing Cup |
| 43B | Bottom Head Ball Bearings (40) |
| 43T | Top Head Ball Bearings (40) |
| 44B | Bottom Head Bearing Cone |
| 44T | Top Head Bearing Cone |
| 45 | Head Bearing Collar |
| 46 | Head Bearing Clamp |
| 47 | Head Bearing Lock Screws (2) |
| 50 | Backbone Assembly |
| 51 | Backbone |
| 52B | Back Steering Pivot |
| 52F | Front Steering Pivot |
| 52S | Steering Pivot Screws (4) |
| 53 | Steering Lever Block |
| 53S | Steering Lever Block Screws (4) |
| 60 | Rear Wheel Assembly |
| 61 | Back Block |
| 61S | Back Block Screws (8) |
| 62 | Rear Wheel Tube |
| 62S | Rear Wheel Tube Clamping Screws (5) |
| 64L | Left Rear Wheel |
| 64R | Right Rear Wheel |
| 70 | Battery Assembly |
| 71 | Front Battery Mount |
| 71S | Front Battery Mount Screw |
| 72 | Front Battery Support Bar |
| 73 | Rear Battery Mount |
| 73S | Rear Battery Mount Screws (2) |
| 74C | Battery Band Clamp |

-continued

| FIRST EMBODIMENT REFERENCE NUMERALS (FIGS 1B-7F) | |
|---|---|
| 74L | Left Battery |
| 74R | Right Battery |
| 75 | Control Box |
| 75L | Control Box Lid |
| 80 | Front Truck Assembly |
| 81 | Truck Block |
| 82L | Left Truck Plate |
| 82R | Right Truck Plate |
| 82S | Truck Plate Screws |
| 83 | Front Axle |
| 83LB | Left Front Axle Bearing |
| 83LS | Left Front Axle Screw |
| 84 | Front Wheel |
| 84P | Front Wheel Pulley |
| 84S | Front Wheel Pulley Screws |
| 85T | Top Motor Clamp Rod |
| 85B | Bottom Motor Clamp Rod |
| 85S | Motor Clamp Rod Screws (4) |
| 86 | Motor |
| 86C | Motor Band Clamp |
| 87 | Motor Pulley |
| 80 | Front Truck Assembly (continued) |
| 88 | Motor Pulley Collar |
| 88C | Motor Pulley Clamp |
| 88S | Motor Pulley Clamp Screws (2) |
| 89 | Drive Belt |
| 90 | Steering Linkage Assembly |
| 91 | Steering Lever |
| 92 | Steering Lever Axle |
| 92S | Steering Lever Axle Screw |
| 92W | Steering Lever Axle Washer |
| 93H | Short Con Rod High End |
| 93HS | Short Con Rod High End Screw |
| 93L | Short Con Rod Low End |
| 94B | Long Con Rod Back End |
| 94F | Long Con Rod Front End |
| 94FS | Long Con Rod Front End Screw |
| 94T | Long Con Rod Threaded Rod |

| SECOND EMBODIMENT REFERENCE NUMERALS (FIGS. 1A, 8A-10B) | |
|---|---|
| | Deck Assembly |
| 211 | Deck |
| 212 | Left Deck Bar |
| 213 | Right Deck Bar |
| | Backbone Assembly |
| 221 | Steering Head |
| 222 | Backbone |
| 223 | Throttle Pivot Pin |
| 224 | Throttle Dampener Pad |
| 225 | Front Steering Pivot Block |
| 226 | Rear Steering Pivot Block |
| | Throttle Assembly |
| 231 | Throttle Potentiometer |
| 232 | Throttle Finger |
| 233 | Throttle Actuator Pin |
| | Front Truck Assembly |
| 241 | Fork Block |
| 242 | Lower Bearing |
| 243 | Upper Bearing |
| 244 | Steering Head Bolt |
| 245 | Left Truck Plate |
| 246 | Right Truck Plate |
| 251 | Front Wheel |
| 252 | Front Wheel Pulley |

-continued

| SECOND EMBODIMENT REFERENCE NUMERALS (FIGS. 1A, 8A-10B) | |
|---|---|
| 253 | Front Axle |
| 254 | Motor |
| 255 | Drive Belt |
| | Rear Truck Assembly |
| 261 | Front Cross Plate |
| 262 | Rear Cross Plate |
| 263 | Upper Battery Plate |
| 264 | Lower Battery Plate |
| 265 | Front Steering Pin |
| 266 | Rear Steering Pin |
| 267 | Left Rear Wheel |
| 268 | Right Rear Wheel |
| 269 | Steering Dampener Pad |
| 271 | Left Battery |
| 272 | Right Battery |
| 273 | Left Battery Clamp Bar |
| 275 | Left Handle |
| 276 | Right Handle |
| | Steering Linkage Assembly |
| 281 | Steering Lever |
| 282 | Steering Lever Pivot Pin |
| 283 | Short Steering Con Rod |
| 284 | Long Steering Con Rod |

STRUCTURE OF FIRST EMBODIMENT

Figure 1A:
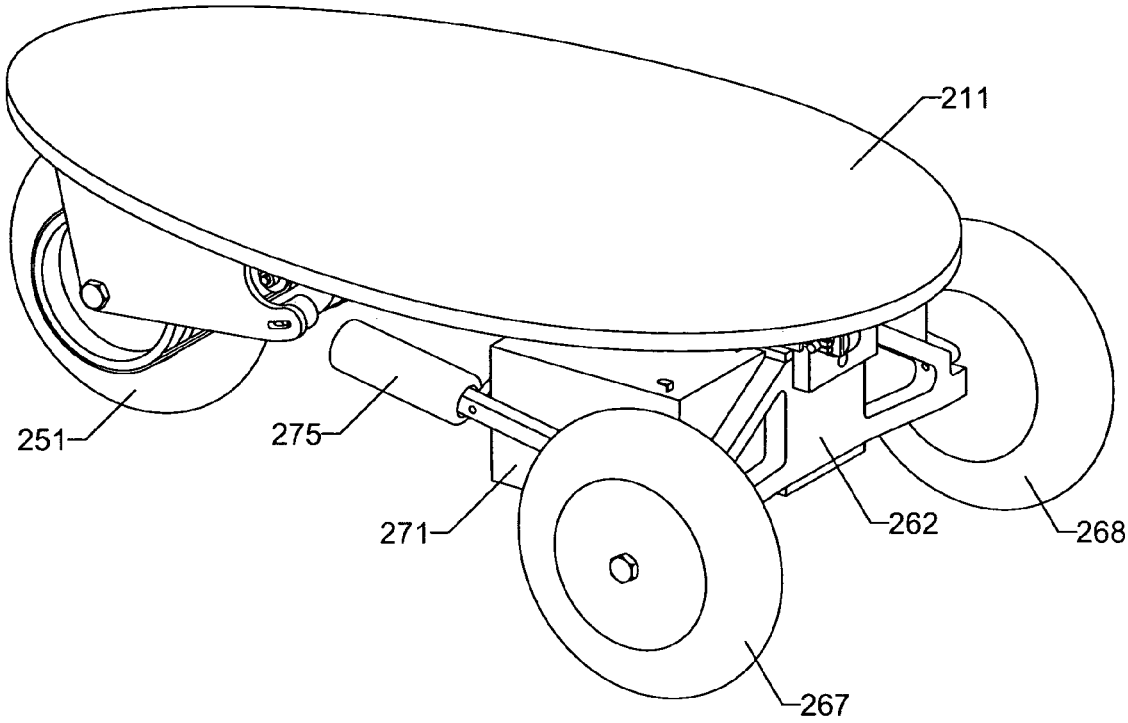
FIG. 1A is a left side view of the second embodiment of a Foot-Controlled Motorized Vehicle according to this invention.
Figure 1B:
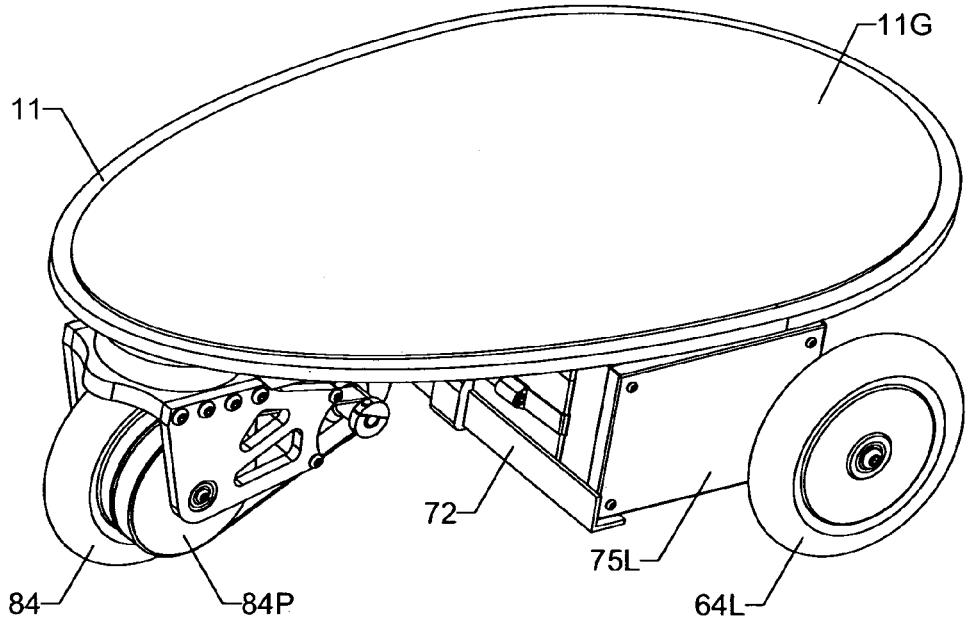
FIG. 1B is a left side view of the first embodiment of a Foot-Controlled Motorized Vehicle according to this invention.
Figure 2:
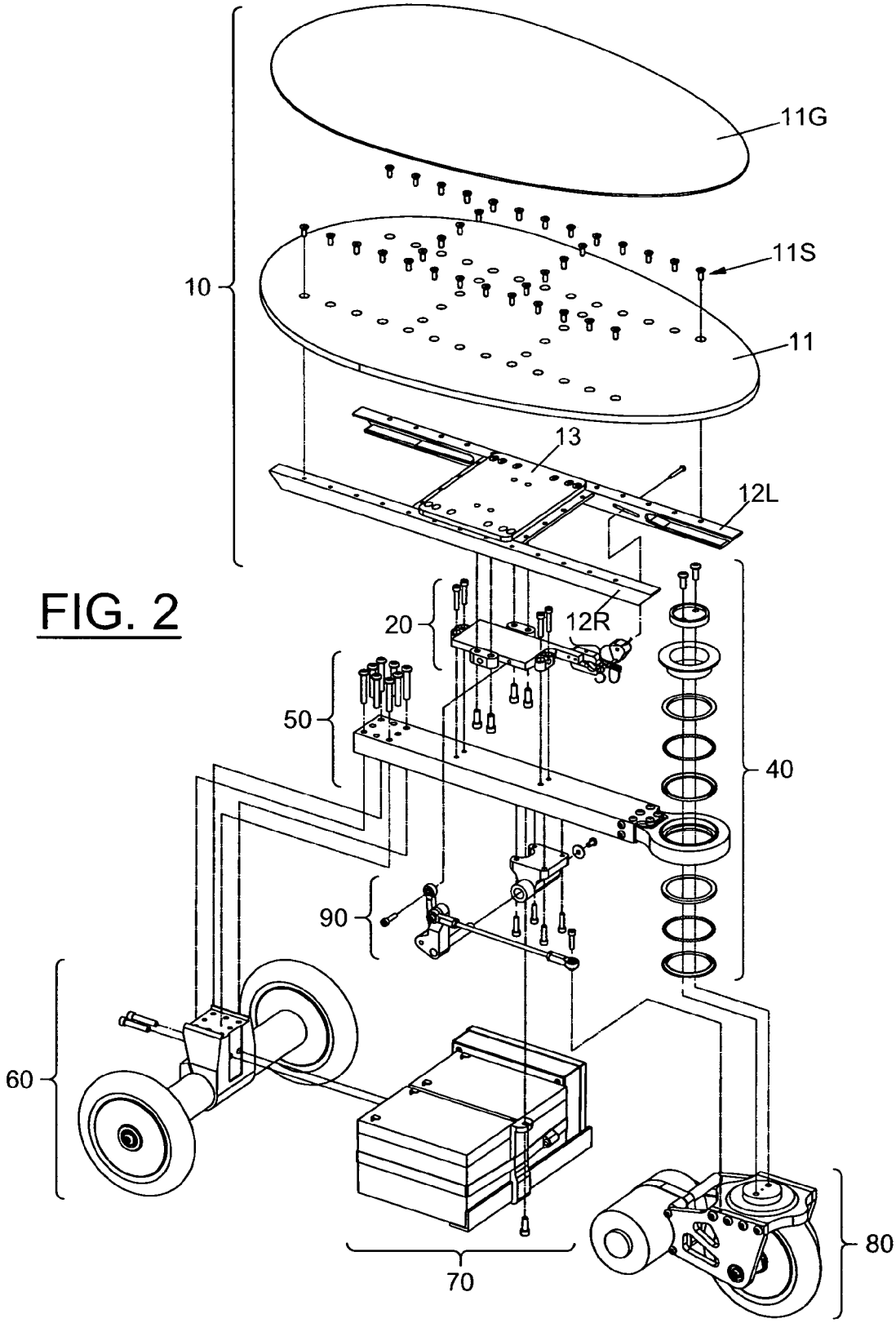
FIG. 2 is an exploded right side view of the first embodiment showing major assembly groups and selected parts.
Figure 3:
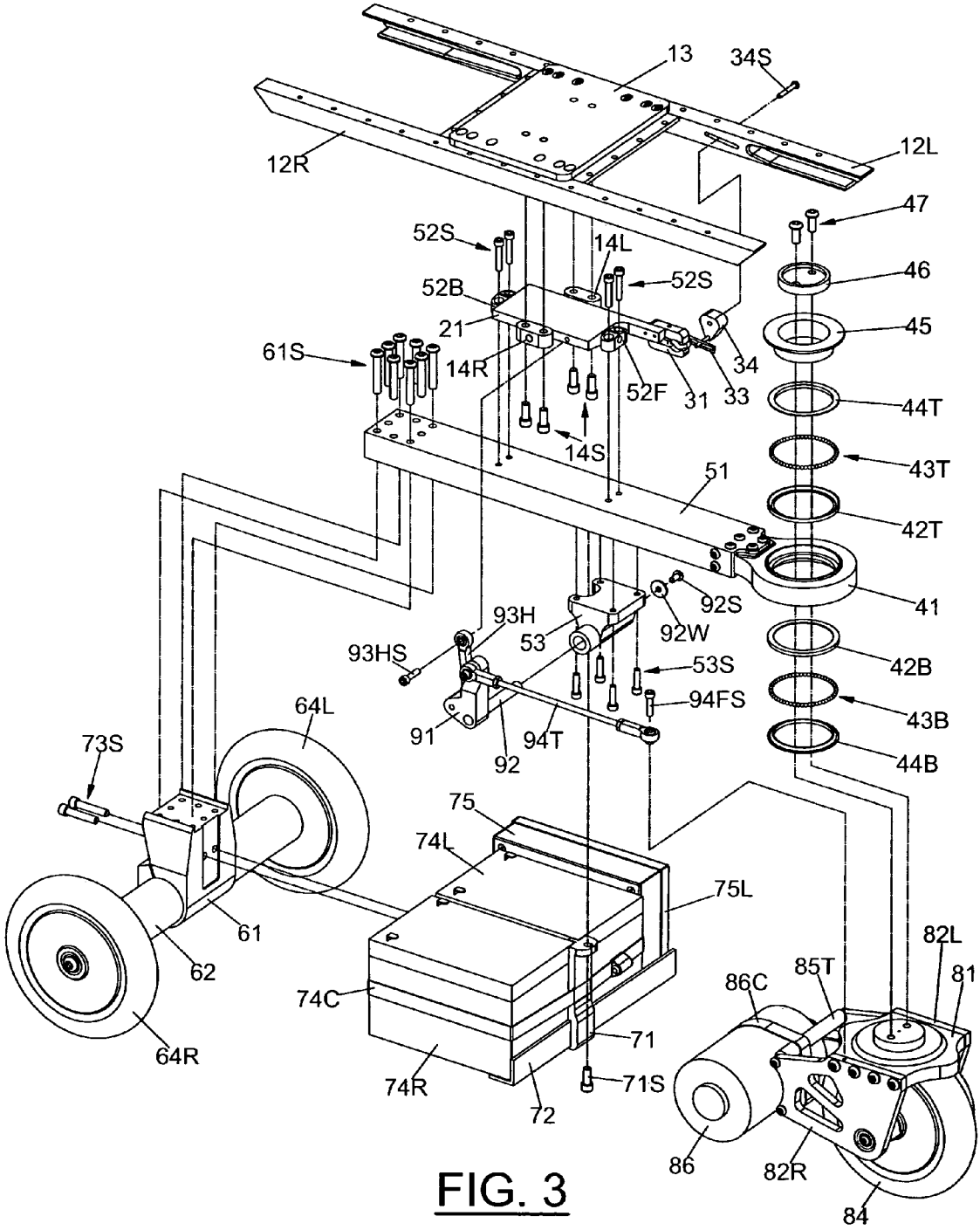
FIG. 3 is an exploded right side view of the first embodiment with Deck 11, Deck Grip Tape 11G and Deck Screws 11S removed.

FIGS. 1B through 7F illustrate the structure of the first embodiment. As can be seen in FIG. 2, the first embodiment is roughly divided into nine sub-assemblies. FIG. 3 shows most of these sub-assemblies in greater detail.

Deck Assembly 10 (FIG. 2)

Deck Bars 12L & R are screwed to a central Deck Block 13. Deck 11 is screwed by Deck Screws 11S to Deck Block 13 and Deck Bars 12L & R. A piece of adhesive-backed skateboard Grip Tape 11G is applied to Deck 11. This Grip Tape 11G provides a non-slip surface for the rider's feet. Left and right Throttle Pivots 14L & 14R are fastened to the bottom of Deck Block 13 by Throttle Pivot Screws 14S (FIG. 3). Hardened Left & Right Throttle Pivot Pins 22L & 22R (FIG. 5A) protrude into the Throttle Pivots 14L & 14R (FIG. 3).

Figure 5A:
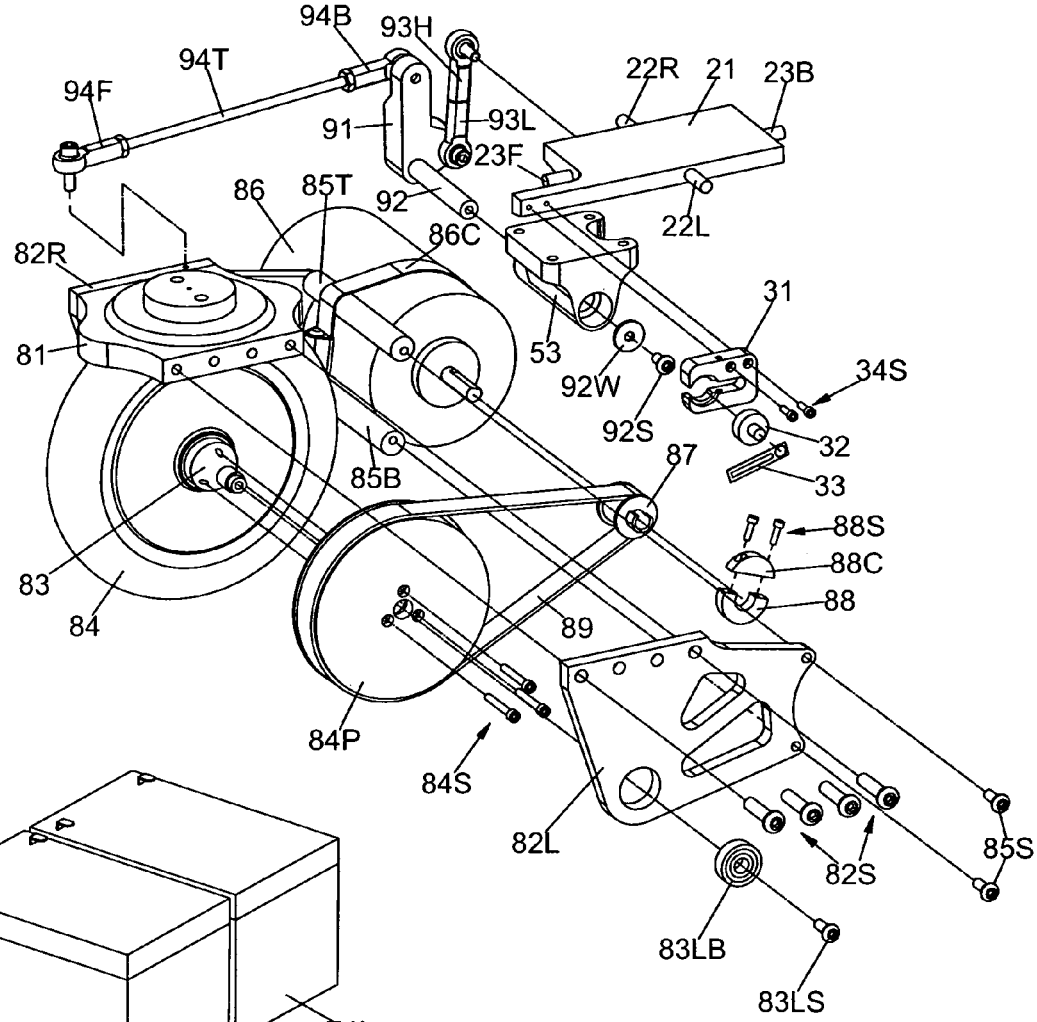
FIG. 5A is an exploded left side view of Central Rocker Assembly 20, Throttle Assembly 30, Front Truck Assembly 80 and Steering Linkage Assembly 90.

Central Rocker Assembly 20 (FIGS. 2, 3, 5A)

Throttle Pivot Pins 22L & 22R are press fitted into holes in the left and right sides of Central Rocker 21 (FIG. 3). Steering Pivot Pins 23F & 23B are respectively press fitted into holes in the front and rear of Central Rocker 21. Central Rocker 21 has threaded holes where Throttle Potentiometer Clamp 31 is mounted (FIG. 5A). Central Rocker 21 also has a threaded hole where Short Con Rod Top End 93 is mounted by Short Con Rod High End Screw 93HS (FIG. 3).

Figures 4A, 4B:
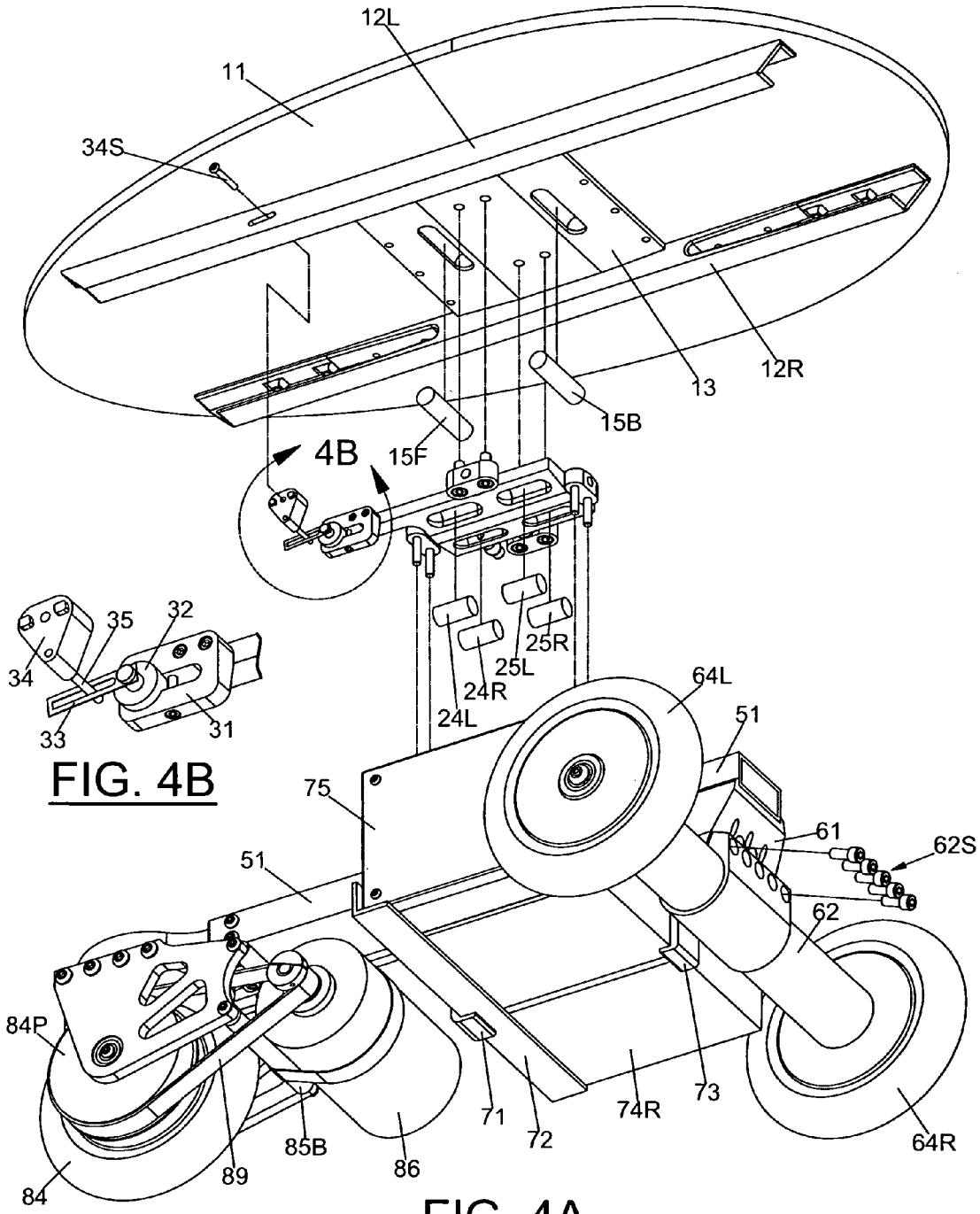
FIG. 4A is an exploded lower left side view of the first embodiment showing Throttle Dampeners 15F & 15B and Steering Dampeners 24L, 24R, 25L, 25R.
FIG. 4B is a detail view of Throttle Assembly 30 from FIG. 4A.

Throttle Assembly 30 (FIGS. 2, 3, 4B)

Throttle Potentiometer Clamp 31 grips the outer housing of Throttle Potentiometer 32 (FIG. 4B). Throttle Finger 33 is fixedly mounted on the wiper shaft of Throttle Potentiometer 32. Throttle Pin 35 is press fitted into a lateral hole in Throttle Pin Block 34. Pin 35 protrudes out of the right side of Pin Block 34 and extends into a slot in Throttle Finger 33. Throttle Pin Block 34 is mounted to Left Deck Bar 12L with Throttle Pin Block Screw 34S (FIG. 4A).

Head Assembly 40 (FIGS. 2, 3)

The components of Head Assembly 40 (FIG. 2) comprise the rotational steering union attaching Front Truck Assembly 80 to the vehicle. In form and function, this rotational steering union is similar to one which might be found on a bicycle headset. It utilizes an upper and lower cup-and-cone antifriction bearing set which pivotably connects Truck Assembly 80 to the vehicle. FIG. 3 is an exploded view of the components of Head Assembly 40.

Top Head Bearing Cup 42T is seated in a counterbore in the top of Head 41. Bottom Head Bearing Cup 42B is seated in a similar counterbore in the bottom of Head 41. Top Head Ball Bearings 43T are retained between Top Head Bearing Cup 42T and Top Head Bearing Cone 44T. Bottom Head Ball Bearings 43B are similarly retained between Bottom Head Bearing Cup 42B and Bottom Head Bearing Cone 44B.

Head Bearing Collar 45 is internally threaded and screws onto the externally threaded circular protrusion on the top of Truck Block 81. Top Head Bearing Cone 44T is seated up against the flange and around the small outside diameter of Head Bearing Collar 45. This small outside diameter of Collar 45 extends down through the steering union. At its lower end, this portion of Collar 45 slips partially into the bore of Bottom Head Bearing Cone 44B. Bottom Cone 44B is thereby radially constrained by this close-fitting lower portion of Collar 45. Bottom Cone 44B is also seated upon the upward-facing surface on Truck Block 81 where the threaded protrusion arises.

Head 41 is sandwiched between what is essentially a pair of opposing, top and bottom ball bearing sets. These bearing sets are in turn constrained between the previously mentioned flange on Head Bearing Collar 45 and the upward-facing surface on Truck Block 81. The cups and cones of both bearing sets are arranged to create a complementary pairing of angular contact antifriction bearings. As such, the assembly provides axial and radial constraints while allowing Truck Assembly 80 to rotate freely on a vertical axis.

Adjustment of play in the steering union is achieved by turning Head Bearing Collar 45 with respect to Truck Block 81. Because Bearing Collar 45 is screwed onto Truck Block 81 this changes the axial gap within which the bearing assembly must operate. Head Bearing Clamp 46 is externally threaded and screws down inside Head Bearing Collar 45. Bearing Clamp 46 however does not touch the top of Truck Block 81. Head Bearing Lock Screws 47 extend through Collar 45 and thread into Truck Block 81. When these Lock Screws 47 are tightened, they draw Head Bearing Clamp 46 toward Truck Block 81. This exerts a clamping force at the mating threads of Head Bearing Collar 45 and Truck Block 81. The friction created by the clamping force at the threads prevents further screwing or unscrewing of Collar 45. Thus the bearing assembly may be locked in place when the desired amount of bearing play is realized.

Backbone Assembly 50 (FIGS. 2, 3)

Backbone 51 is a rectangular tube (FIG. 3). Steering Pivots 52F & 52B are fastened atop Backbone 51 by Steering Pivot Screws 52S. Steering Lever Block 53 is mounted to the bottom of Backbone 51 by Steering Lever Block Screws 53S. Head 41 is mounted to Backbone 51 by a portion which fits inside the front end of Backbone 51 and is rigidly held there. Back Block 61 is mounted on the bottom side of Backbone 51 at its rear end and held there by Back Block Screws 61S.

Rear Wheel Assembly 60 (FIGS. 2, 3, 4A)

Rear Wheel Tube 62 is mounted in a bore running transversely through Back Block 61 (FIG. 4A). The bore has a slit on its upper rear side that extends for the width of Back Block 61. Rear Wheel Tube Clamping Screws 62S are used to close this slit. When the slit in Back Block 61 closes, the bore wraps more tightly around Rear Wheel Tube 62 thereby clamping it in place. Left & Right Rear Wheels 64L & 64R are mounted respectively to the left & right ends of Rear Wheel Tube 62. Each wheel is mounted by a screw extending through antifriction bearings seated in each side of the wheel's hub. The screw threads into cylindrical pieces press fitted into the ends of Rear Wheel Tube 62 (not shown). The inner races of each wheel's pair of antifriction bearings are separated by a spacer. The length of the spacer is chosen to allow the mounting screw to be tightened very firmly without applying adverse or locking forces upon the bearing's balls & races. Left & Right Rear Wheels 64L & 64R have pneumatic tires.

Battery Assembly 70 (FIGS. 2, 3, 4A, 5B)

Figure 5B:
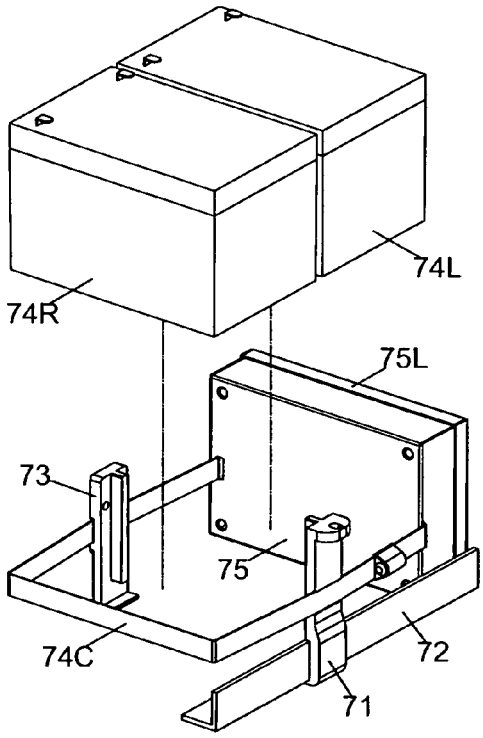
FIG. 5B is a right side view of Battery Assembly 70 with Batteries 74L & 74R moved up for an unobstructed view of other components.
Figure 6A:
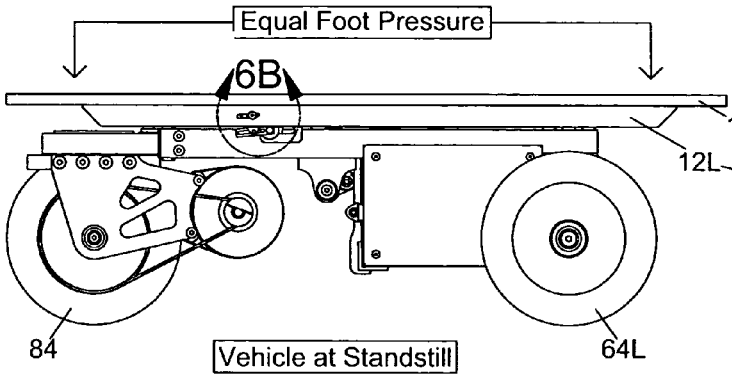
FIG. 6A is a left side view of the first embodiment with Deck 11 in a neutral throttle position.
Figure 6B:
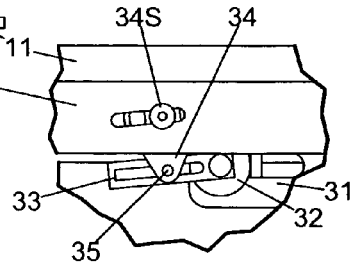
FIG. 6B is a detail view of Throttle Assembly 30 shown in FIG. 6A.
Figure 6C:
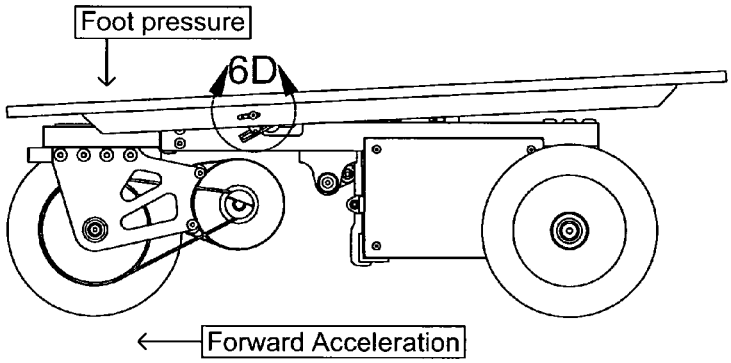
FIG. 6C is a left side view of the first embodiment with Deck 11 tilted in the forward throttle position.
Figure 6D:
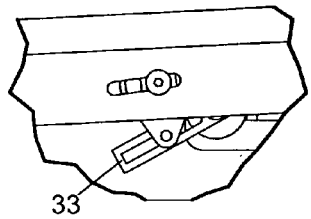
FIG. 6D is a detail view of Throttle Assembly 30 shown in FIG. 6C.
Figure 6E:
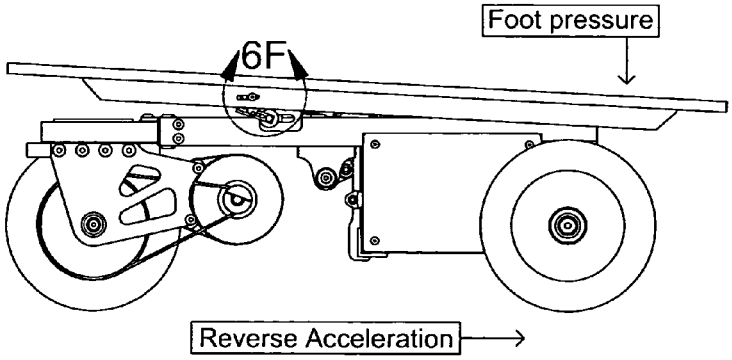
FIG. 6E is a left side view of the first embodiment with Deck 11 tilted in the reverse throttle position.
Figure 6F:
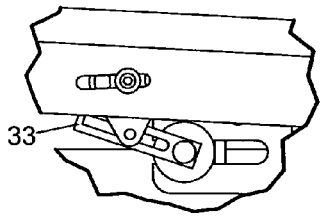
FIG. 6F is a detail view of Throttle Assembly 30 shown in FIG. 6E.
Figure 7A:
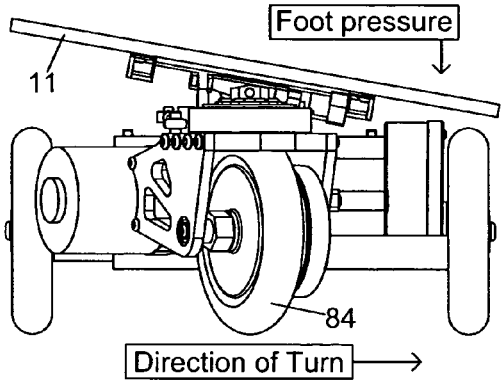
FIG. 7A is a frontal view of the first embodiment in a left turn position.
Figure 7D:
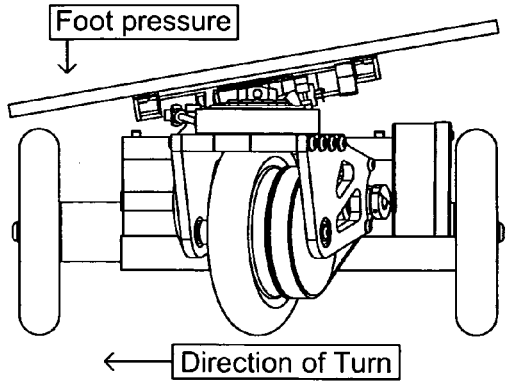
FIG. 7D is a frontal view of the first embodiment in a right turn position.
Figure 7B:
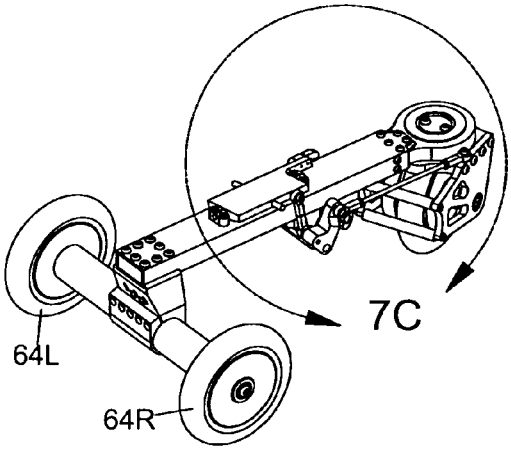
FIG. 7B is a right side view of the first embodiment in a left turn position with Deck 11 removed for clarity.
Figure 7E:
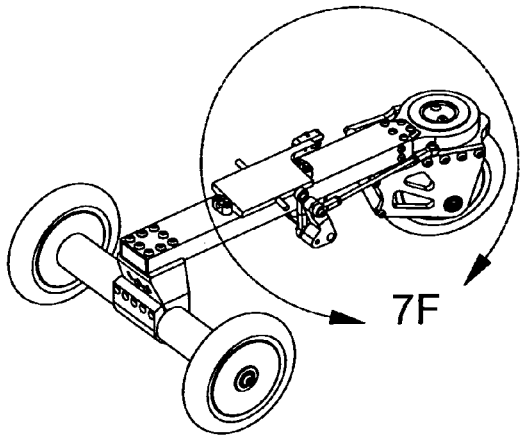
FIG. 7E is a right side view of the first embodiment in a right turn position with Deck 11 removed for clarity.
Figure 7C:
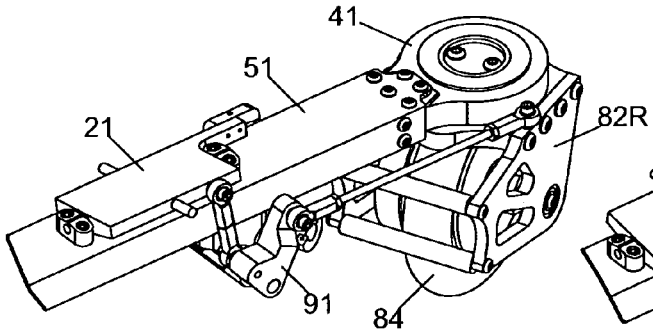
FIG. 7C is a detail view of the steering components shown in FIG. 7B.
Figure 7F:
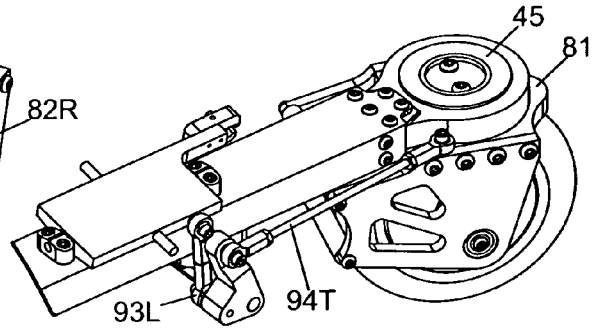
FIG. 7F is a detail view of the steering components shown in FIG. 7E.

A pair of sealed lead-acid batteries, Left & Right Batteries 74L & 74R are secured to Front & Rear Battery Mounts 71 & 72 by Battery Band Clamp 74C (FIG. 5B). Front & Rear Battery Mounts 71 & 72 have "T" shape viewed from the top. Each Battery Mount 71 & 72 has a central member which is clamped between the two batteries. Each Battery Mount 71 & 72 also has a cross member which holds the ends of the batteries when Battery Band Clamp 74C is tightened. Rear Battery Mount 73 has a ledge at its lower end. This ledge supports the bottom of the batteries at their lower rear corners. Front Battery Mount 71 has a channel at its lower end. Front Battery Support Bar 72 fits into this channel. Front Battery Support Bar 72 is a standard right angle extrusion and supports the batteries at their front, lower edge. Front Battery Support Bar 72 also protects the front, lower edge of batteries 74L & 74R. This front, lower edge can be somewhat vulnerable to impact during adverse riding conditions.

Battery Assembly 70 is attached to Backbone Assembly 50 in the front and rear. In the front, Front Battery Mount 71 attaches to Backbone 51 by Front Battery Mount Screw 71S. In the rear, Rear Battery Mount 73 is fastened to Back Block 61 by Rear Battery Mount Screws 73S.

Battery Band Clamp 74C also extends through two slots in the back of Control Box 75. This fastens Control Box 75 to the left side of Left Battery 74L. Control Box 75 contains a Pulse-Width-Modulated (PWM) type of motor speed controller. This speed controller efficiently controls the speed of Motor 86 during operation of the vehicle. Control Box Lid 75L fits over Control Box 75 covering and protecting the PWM circuit board. Appropriate wiring (not shown) is used to electrically connect the motor speed controller to Throttle Potentiometer 32. Appropriate wiring (not shown) also connects the speed controller to Left & Right Batteries 74L & 74R and Motor 86. Control Box 75 has rubber-grommeted holes (not shown) which allow needed wires (not shown) to pass through its sides.

Front Truck Assembly 80 (FIGS. 2, 3, 4A, 5A)

Front Axle 83 has Front Wheel 84 and Front Wheel Pulley 84P rigidly attached to it (FIG. 5A). Front Wheel 84 has a pneumatic tire. The left end of Front Axle 83 is secured to the inner race of Left Front Axle Bearing 83LB by Left Front Axle Screw 83LS. Left Front Axle Bearing 83LB is press fitted into Left Truck Plate 82L creating a rotational connection between the axle and truck plate. The right end of Front Axle 83 is rotationally connected to Right Truck Plate 82R in a similar manner though this is not detailed in the drawings.

Left & Right Truck Plates 82L & 82R are attached to Truck Block 81 by Truck Plate Screws 82S (screws on right not shown). Motor 86 is clamped to Top & Bottom Motor Clamp Rods 85T & 85B by Motor Band Clamp 86C. Top & Bottom Motor Clamp Rods 85T & 85B are mounted between Left & Right Truck Plates 82L & 82R. The ends of the Clamp Rods are attached to the Truck Plates by Motor Clamp Rod Screws 85S. One Clamp Rod Screw is used for each Clamp Rod end. The threaded holes in the ends of Motor Clamp Rods 85T & 85B are eccentrically positioned with respect to the Clamp Rod's outer diameters. This allows the running tension of Drive Belt 89 to be adjusted by rotating either or both Motor Clamp Rods. This is done before final tightening of Motor Clamp Rod Screws 85S and Motor Band Clamp 86C. Each Motor Clamp Rod has a crosswise hole (not shown) through which a thin rod (not shown) may be inserted. This thin rod can then act as a wrench to turn Motor Clamp Rods 85T & 85B when adjusting the tension on Drive Belt 89.

Motor Pulley 87 is rigidly clamped to the output shaft of Motor 86 by Motor Pulley Clamp Screws 88S. This is accomplished with the aid of a relieved portion on the extended hub of Motor Pulley 87. This relieved portion corresponds to a flat on Motor Pulley Collar 88 and the output shaft of Motor 86. Motor Pulley Clamp Screws 88S extend through Motor Pulley Clamp 88C and thread into Motor Pulley Collar 88. When tightened, the Clamp Screws draw Motor Pulley Clamp 88C toward Motor Pulley Collar 88. This securely clamps Motor Pulley 87 to the output shaft of Motor 86. Drive Belt 89 is a toothed, non-slip timing belt which wraps around and rotationally links Motor Pulley 87 and Front Wheel Pulley 84P.

Steering Linkage Assembly 90 (FIGS. 2, 3, 5A)

Steering Lever Axle 92 is rigidly press fitted into Steering Lever Block 53 (FIG. 5A). Steering Lever Axle 92 extends into a close fitting hole in Steering Lever 91. This pivotably attaches Steering Lever 91 to Steering Lever Block 53. Steering Lever Axle 92 is retained on Steering Lever Axle 92 by Steering Lever Axle Washer 92W and Steering Lever Axle Screw 92S. Axle Screw 92S threads into the left end of Steering Lever Axle 92.

A short con rod is made up of Short Con Rod High End 93H and Short Con Rod Low End 93L which are attached by a short threaded rod (not shown). Ball joints on the ends of the short con rod attach the Con Rod to the right edge of Central Rocker 21 at one end, and the rear leg of Steering Lever 91 at the other end. At the high end, Short Con Rod High End Screw 93HS extends through the ball joint and threads into the right edge of Central Rocker 21 (FIG. 3). The lower end of the con rod is attached to the rear leg of Steering Lever 91 in a similar manner.

A long con rod is made up of Long Con Rod Front End 94F and Long Con Rod Back End 94B which are attached by Long Con Rod Threaded Rod 94T (FIG. 5A). Ball joints on the ends of the long con rod attach it to the top leg of Steering Lever 91 at one end, and the top of Right Truck Plate 82R at the other end. At the front end, Long Con Rod Front End Screw 94FS extends through the ball joint and threads into the top edge of Truck Plate 82R (FIG. 3). The back end of the con rod is attached to the upward-extending leg of Steering Lever 91 in a similar manner.

Operation of First Embodiment

Overview of Acceleration and Deceleration (FIGS. 6A-6F)

In its resting position Deck 11 is approximately parallel to the ground and the vehicle moves neither forward nor backward. Acceleration, deceleration and reversal of the vehicle's direction are controlled by tilting Deck 11 either forward or backward. When the rider's weight is shifted forward over the front foot, Deck 11 tilts forward and the vehicle accelerates in that direction. When more weight is shifted to the rear foot, Deck 11 tilts backward and the vehicle accelerates in that direction. Acceleration and deceleration are variable so the vehicle responds in proportion to the amount of weight change.

Details of Acceleration and Deceleration

Deck 11 tilts forward or backward at the pivotal connection created by Throttle Pivots 14L & 14R (FIG. 3) and Throttle Pivot Pins 22L & 22R (FIG. 5A). As Deck 11 is tilted forward or backward, Throttle Pin 35 moves up or down causing a corresponding motion in Throttle Finger 33 (FIGS. 6A through 6F). This occurs because Throttle Pin 35 rides in the slot in Throttle Finger 33. This in turn causes the wiper shaft of Throttle Potentiometer 32 to turn. Throttle Potentiometer 32 is electrically connected to the motor speed controller (not shown). The speed controller delivers current from Batteries 74L & 74R to Motor 86 causing the vehicle to roll forward or backward in response to the forward or backward tilting of Deck 11.

Overview of Steering (FIGS. 7A-7F)

The vehicle is steered in the same manner as a regular skateboard. The side-to-side tilting motion of Deck 11 causes the vehicle to turn in the same direction that Deck 11 is tilted.

Details of Steering

Deck 11 tilts side-to-side on the pivotal connection created by Steering Pivots 52F & 52B (FIG. 3) and Steering Pivot Pins 23F & 23B (FIG. 5A). The left or right tilting of Deck 11 causes Central Rocker 21 to also tilt. When Central Rocker 21 tilts, its right edge moves up and down urging a corresponding motion in the short con rod. The short con rod in turn causes Steering Lever 91 to pivot by pushing on its rear leg. The forward or backward pivoting of Steering Lever 91 causes a corresponding motion in the long con rod. The long con rod in turn causes Front Truck Assembly 80 to turn by urging Right Truck Plate 82R to move forward or backward. Front Truck Assembly 80 pivots at the steering union created by the antifriction bearing connection of Truck Assembly 80 with Head 41 (FIG. 3). Because Front Wheel 84 is part of Truck Assembly 80, this causes the vehicle to turn left or right.

Second Embodiment (FIGS. 1A, 8A-10B)

The second embodiment exemplifies one of the many alternative forms of this vehicle. It features a Front Wheel 251 which tilts form side-to-side with the side-to-side tilting of Deck 211. This tilting compensates for the destabilizing effect of centrifugal force when turning the vehicle at higher speeds. This is similar to the natural tilting that occurs in a bicycle when rounding a corner. This embodiment also has handles which are used for conveniently carrying the vehicle.

STRUCTURE OF SECOND EMBODIMENT

Figure 8A:
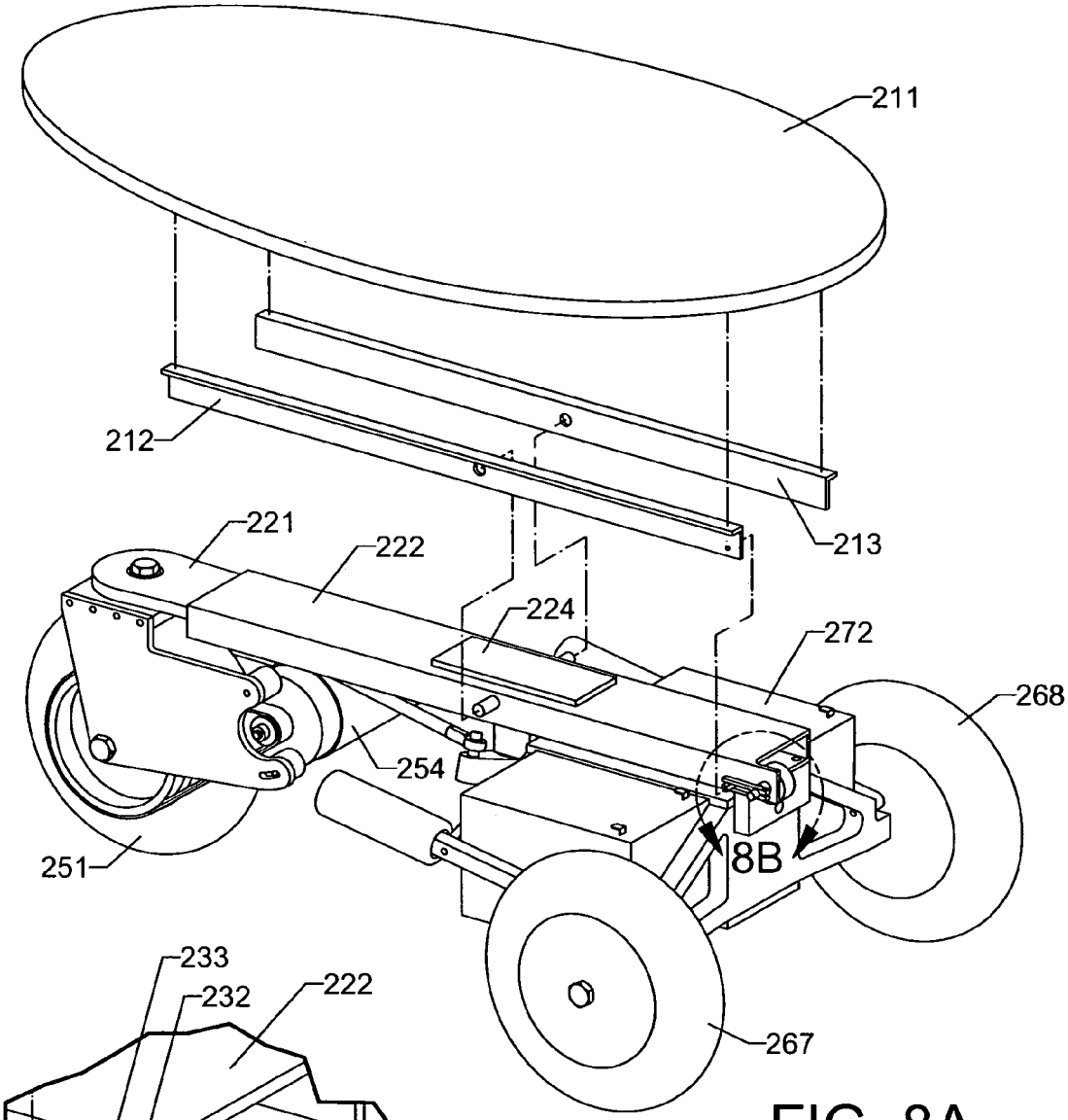
FIG. 8A is a left side view of the second embodiment with Deck 211 and Deck Bars 212 & 213 lifted for unobstructed viewing of lower assembly.
Figure 8B:
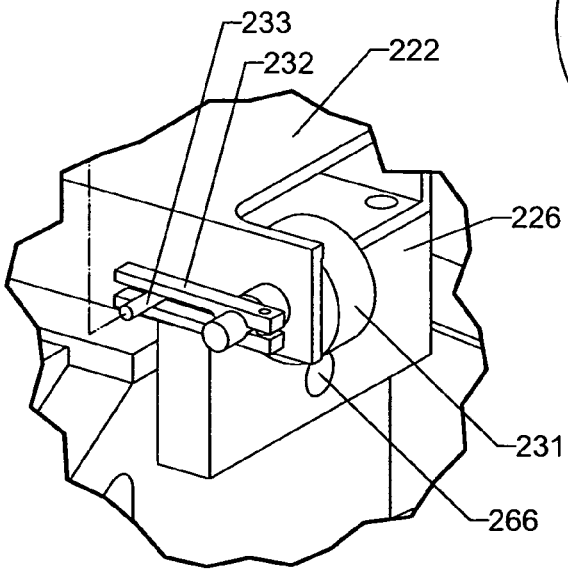
FIG. 8B is a detail view of the second embodiment throttle actuating components shown in FIG. 8A.

Deck 211 is fastened atop Left Deck Bar 212 & Right Deck Bar 213 (FIG. 8A). Throttle Pivot Pin 223 is press fitted into and extends out of both sides of a hole in Backbone 222. Throttle Pivot Pin 223 provides a lateral axis for Deck Bars 212 & 213 to pivot upon during throttle actuation. Throttle Dampener Pad 224 is a springy rubber pad which provides resistance to this forward or backward pivoting. Throttle Actuator Pin 233 is press fitted into a lateral running hole in Left Deck Bar 212 and extends into a slot in Throttle Finger 232 (FIG. 8B). Throttle Finger 232 is rigidly mounted to the wiper shaft of Throttle Potentiometer 231. Throttle Potentiometer 231 is mounted in a lateral running hole in a rearward extending portion of Backbone 222. Backbone 222 is a rectangular tube. Steering Head 221 extends into and is rigidly mounted to the front of Backbone 222.

Figure 9A:
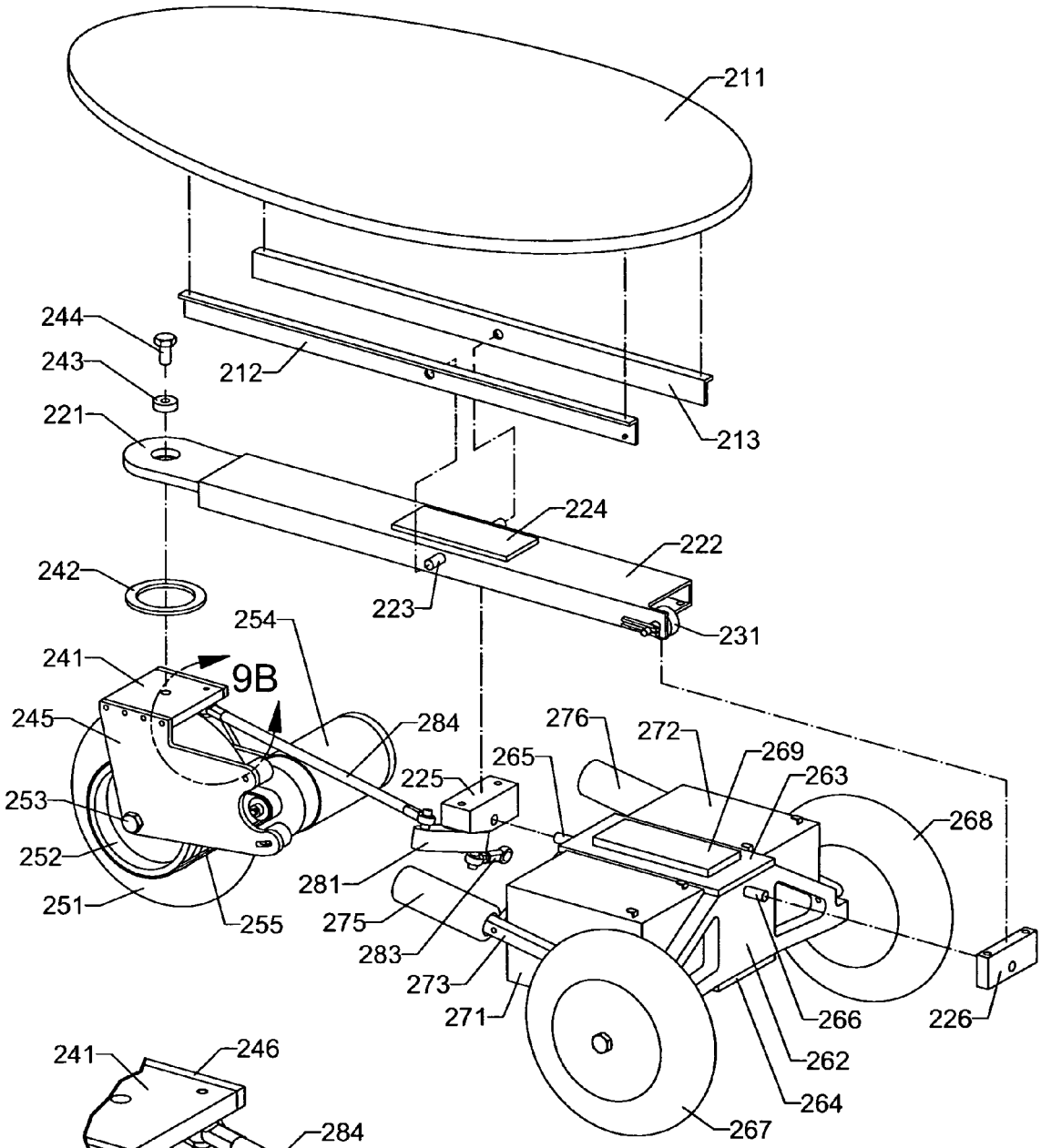
FIG. 9A is an exploded left side view of the second embodiment of this invention.
Figure 9B:
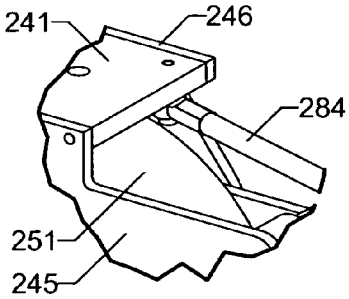
FIG. 9B is a detail view of Long Steering Con Rod 284 and its connection to Front Truck Cross Plate 261 shown in FIG. 9A.
Figure 10A:
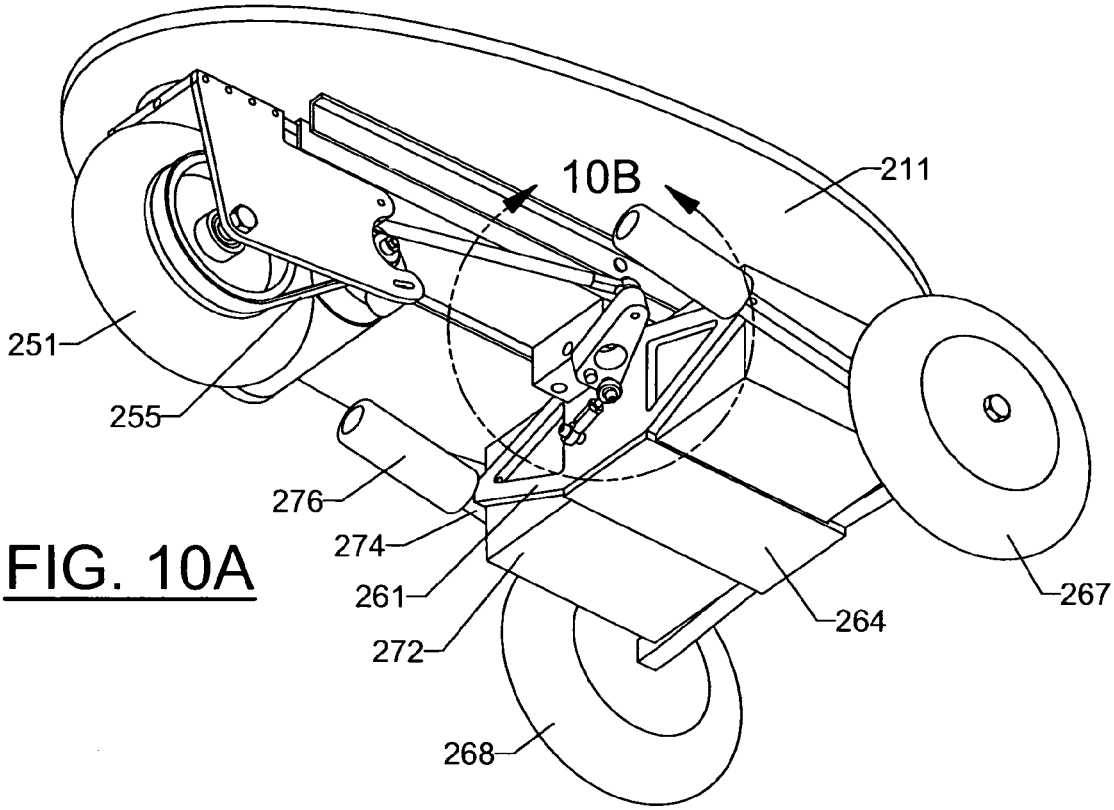
FIG. 10A is a lower left side view of the second embodiment.
Figure 10B:
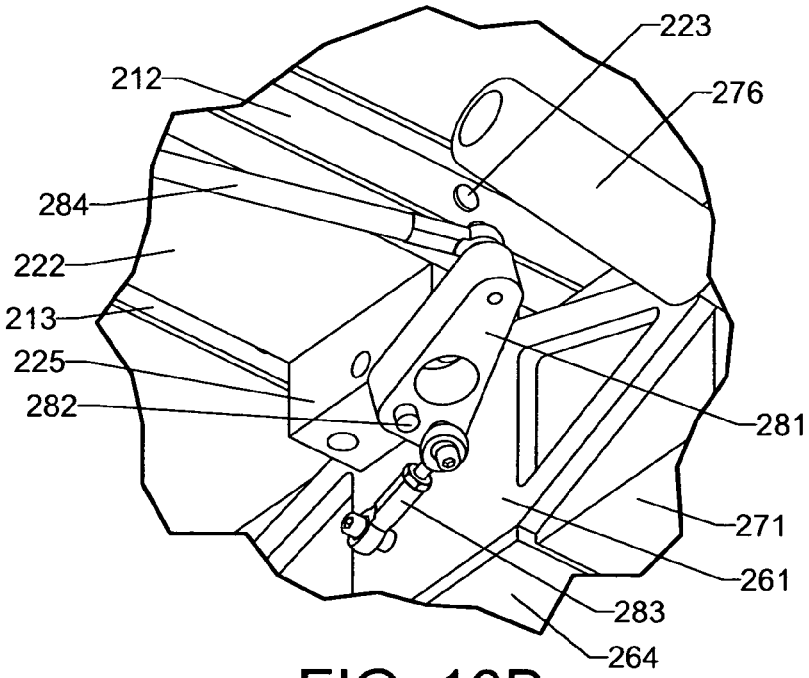
FIG. 10B is a detail view of Steering Lever 281 and associated steering control components shown in FIG. 10A.

The front truck is pivotably mounted to Steering Head 221 via Lower & Upper antifriction Bearings 243 & 243. The front truck is very similar to the front truck of the first embodiment discussed earlier. A notable difference is the connection point for Long Steering Con Rod 284 (FIG. 9B). Short Steering Con Rod 283 & Long Steering Con Rod 284 are connecting rods with ball joints on each end. The front ball joint on Long Con Rod 284 mounts to the underside of Fork Block 241. Long Con Rod 284 extends back and is connected at the rear ball joint to Steering Lever 281 (FIGS. 9A & 10B). Steering Lever 281 pivots upon Steering Lever Pivot Pin 282 (FIG. 10B). Pin 282 is press fitted into a slightly angled hole in the lower side of Front Steering Pivot Block 225. The rightmost end of Short Steering Con Rod 283 is fastened at its ball joint to the front of Front Cross Plate 261. The leftmost end of the Con Rod is fastened at its ball joint to Steering Lever 281 as shown.

Front Steering Pin 265 & Rear Steering Pin 266 are respectively press fitted into holes in Front Cross Plate 261 & Rear Cross Plate 262 (FIG. 9A). Front Steering Pivot Block 225 & Rear Steering Pivot Block 226 are screwed to the bottom of Backbone 222. Each Steering Pivot Block has a hole running in a front to back direction. Front Steering Pin 265 extends pivotably into the hole in Front Steering Pivot Block 225. Rear Steering Pin 266 extends pivotably into the hole in Rear Steering Pivot Block 226.

Front Cross Plate 261 is mounted between the front ends of Lower Battery Plate 264 (FIGS. 10A & 10B) & Upper Battery Plate 263 (FIG. 9A). Rear Cross Plate 262 is mounted between the rear ends of Lower & Upper Battery Plates 264 & 263 (FIG. 9A). This structure of the Battery Plates and the Cross Plates forms a protective rectangular box. The delicate motor speed controller (not shown) is mounted inside this box. Left Battery 271 & Right Battery 272 complete the sides of this box. The Batteries are held in place by Left Battery Clamp Bar 273 & Right Battery Clamp Bar 274 (FIGS. 9A & 10A).

Left Handle 275 & Right Handle 276 are mounted to the ends of the Battery Clamp Bars as shown. Left Rear Wheel 267 & Right Rear Wheel 268 are mounted respectively to the left & right ends of Rear Cross Plate 262. A springy rubber Steering Dampener Pad 269 is sandwiched between the top of Upper Battery Plate 263 & the bottom of Backbone 222 (FIG. 9A).

Operation of Second Embodiment

From the rider's standpoint, the second embodiment operates generally like the first embodiment. Please refer to FIGS. 6A-6F, FIGS. 7A-7F, and the "OPERATION OF FIRST EMBODIMENT" section above for a general understanding of this vehicle's operation.

Acceleration and Deceleration

Deck 211 may tilt either forward or backward in response to the rider's forward or backward weight placement (FIG. 8A). This tilting occurs because the Deck's substructure, Deck Bars 212 & 213 pivot upon Throttle Pivot Pin 223. The tilting causes Throttle Actuator Pin 233 to move up and down (FIG. 8B). The Actuator Pin pushes against the inside walls of the slot in Throttle Finger 232. This causes the wiper shaft on Throttle Potentiometer 231 to turn. Throttle Potentiometer 231 is connected to the motor speed controller (not shown) which is in turn connected to, and controls the speed and direction of, Motor 254 (FIG. 9A). The shaft of Motor 254 turns Front Wheel 251 because both are rotationally linked by grooved Drive Belt 255.

In this manner the vehicle moves either forward or backward in response to the rider's forward or backward weight distribution on Deck 211. Throttle Dampener Pad 224 provides a springy resistance to this tilting. This resistance biases the throttle mechanism to normally provide no power to the motor. The vehicle therefore stands still until the throttle is actuated.

Steering

When the rider tilts Deck 11 in a side-to-side direction, the entire vehicle, except for the rear truck assembly, also tilts. The rear truck assembly (which is generally represented by numerals 261 through 276), is prevented from tilting by the laterally spaced Rear Wheels 267 & 268 riding on the ground (FIG. 9A). The pivotal axis for this side-to-side tilting is created by Front & Rear Steering Pins 265 & 266. These Steering Pins pivot respectively in Front & Rear Steering Pivot Blocks 225 & 226.

This tilting action pushes or pulls Short Steering Con Rod 283 at its connection with Front Cross Plate 261 (FIG. 10B). This causes Con Rod 283 to push or pull the portion of Steering Lever 281 to which it is connected. Steering Lever 281 is thereby urged to pivot about the axis created by Steering Lever Pivot Pin 282. This in turn exerts a pushing or pulling force on Long Steering Con Rod 284. Long Steering Con Rod 284 then pushes or pulls on the portion of Fork Block 241 to which it is connected (FIGS. 9A & 9B). This causes the front truck to turn about the rotational steering union between Fork Block 241 and Steering Head 221. The turning of the front truck steers the vehicle. Steering Dampener Pad 269 provides spring resistance to the side-to-side tilting of Deck 11 which biases the vehicle to travel in a straight line.

CONCLUSION, RAMIFICATIONS, AND SCOPE

Thus the reader will see that I have provided a practical and rideable foot-controlled motorized vehicle. This vehicle is completely operable without requiring the repositioning of the rider's feet upon its deck. It provides an improved propulsion system for a vehicle that enjoys the advantages of small size, good maneuverability and hands free operation. The deck of this vehicle is sized to allow the rider to place one foot substantially in front of the other. This enables the rider to maintain stability and balance while accelerating or decelerating. This vehicle may be ridden in a standing, sitting or kneeling position. The vehicle is entirely controllable by the shifting of the rider's weight upon the rider-supporting platform.

I have provided a vehicle that can be accelerated or decelerated in either the forward or reverse direction. It can negotiate a wide variety of adverse terrains and riding conditions. I have also provided a simple and efficient drive system for the vehicle. I have eliminated the need for a differential. I have also eliminated the need for a flexible coupling such as a U-joint or a constant-velocity joint.

I have further provided a vehicle with a unique visual appeal. Its distinctive look differentiates it from other vehicles and provides valuable marketing advantages. Even more objects and advantages of this invention will become apparent through consideration of the drawings and the ensuing descriptions thereof.

While the above description contains many specificities, these should not be construed as limitations on the scope of the invention, but rather as exemplifications of its possible form. A skilled artisan will envision many other variations.

In the first embodiment, a timing belt directly couples the rotation of the motor to that of the drive wheel. With this arrangement, the motor also acts as a brake, slowing the vehicle when the throttle is relaxed and the deck is generally level. The vehicle can however be equipped with an independent brake or brakes, preferably of the drum or disk variety. The brake can be actuated when the throttle is relaxed and not causing any motor rotation.

The sprocket on the drive wheel can be coupled to the drive wheel with a one way clutch or ratcheting freewheel. This will enable the vehicle to coast forward without any resistance from the motor when the motor slows and stops. An embodiment such as this can have brakes that were actuated by simply shifting one's weight to the rear and tilting the rider supporting platform toward the back. With this arrangement the vehicle will have the positive stopping power of brakes instead of the ability to go backwards under power.

Many pivotable connections can be replaced with other types of connections. Instead of pivoting, the deck, for example, can be adhesively attached to the vehicle by a springy rubber piece. This will incorporate the biasing capabilities of the rubber into a connection that functions like a pivot. A screw or screws can also create a sandwiched rubber connection such as that which is found on a standard skateboard truck. Ball joints can also be replaced with other types of connections such as U-joints, flexible rubber unions, etc.

The general mechanical constraints and major assemblies can also be arranged in many different ways. In the first embodiment, for example, the front wheel does not tilt. Whereas in the second embodiment, the front wheel tilts along with the rider supporting deck. In both embodiments the batteries do not tilt with the deck but the batteries can be made to tilt with the deck. Similarly, there are many possible arrangements for steering mechanisms and drive mechanisms. The vehicle can have four wheels. A geared power transmission or a direct drive hub motor can be used instead of a belt drive. A gasoline engine instead of an electric motor can provide power. Accordingly, the scope of the invention should be determined not by the embodiment illustrated, but by the appended claims and their legal equivalents.

The invention claimed is:

1. A weight-controlled vehicle, comprising:

a rider support for carrying a rider, at least three wheels mounted below said rider support for carrying said rider support and for enabling said vehicle to roll when placed upon a riding surface, said wheels being spaced to stably support said vehicle in a statically stable mode to normally prevent said vehicle from tipping when placed upon said riding surface, a motor and a power transmission for rotating at least one of said wheels for propelling said vehicle along said riding surface, a speed control coupling attaching said rider support to lower components of said vehicle and arranged to enable said rider support to tilt relative to said lower components, such tilting occurring in a generally forward or backward direction, a speed control for enabling said rider to control the rolling speed of said vehicle in response to said forward or backward tilting of said rider support, a steering control for enabling said rider to tilt said rider support in a generally side-to-side direction and in response to such tilting, steer said vehicle to the side in which said rider support is tilted when said vehicle rolls upon said riding surface, said rider support having an upward facing surface of a size and shape predetermined to enable operation of said vehicle by a rider situated upon said rider support in a standing, sitting, or kneeling riding position, said upward facing surface being generally free of upwardly extending protrusions which would otherwise substantially inhibit said rider from operating said vehicle in any of said riding positions, whereby said rider may control the rolling speed and steered direction of said vehicle by appropriate tilting of said rider support when said rider is situated upon said rider support in any of said riding positions.

2. The vehicle of claim 1 wherein said speed control includes:

a rolling direction reverser for enabling said motor to propel said vehicle forward when said rider support is tilted into the forward range of its tilting motion and backward when said rider support is tilted into the rearward range of its tilting motion, whereby the direction that said vehicle rolls may be reversed in response to said forward or backward tilting of said rider support.

3. The vehicle of claim 1, further including:

at least one handlebar for stabilizing said rider while said rider is situated on said rider support, said handlebar being removable from said vehicle for enabling said rider to operate said vehicle with hands free and to operate and store said vehicle with reduced encumbrance from said handlebar.

4. The vehicle of claim 1, further including:

at least one handlebar for stabilizing said rider while said rider is situated on said rider support, and a clamping articulation for tucking said handlebar to a lower, less obtrusive position for enabling said rider to operate said vehicle with hands free and to operate and store said vehicle with reduced encumbrance from said handlebar.

5. The vehicle of claim 1, further including:

a steerable truck attached below said rider support by a steering union for enabling said steerable truck to pivot along a steering axis, at least two of said wheels being truck wheels rotatably attached to the left and right extremities of said steerable truck and spaced to normally prevent said vehicle from tipping in a side-to-side direction, said steering axis generally falling within a left-right facing plane and also being substantially inclined to translate said side-to-side tilting of said rider support into appropriate left or right turning motion of said steerable truck for causing said truck wheels to steer said vehicle to the left or right in response to said side-to-side tilting of said rider support, at least one said remaining wheel being a drive wheel rotationally coupled to said motor by said power transmission for propelling said vehicle along said riding surface, said drive wheel being located substantially in front or behind said truck wheels to prevent said vehicle from tipping in a front-to-back direction.

6. The vehicle of claim 1 wherein at least one of said wheels is a drive wheel, and further including:

a steerable truck attached below said rider support by a steering union for enabling said steerable truck to turn to the left or right, a steering linkage coupling said rider support to said steerable truck for turning said steerable truck to the left or right in response to said side-to-side tilting of said rider support, said drive wheel being mounted to said steerable truck for steering said vehicle to the left or right when said steerable truck turns to the left or right in response to said side-to-side tilting of said rider support, said motor also being mounted to said steerable truck and rotationally coupled to said drive wheel for propelling said vehicle along said riding surface.

7. The vehicle of claim 1, further including:

a steering biasing spring constrained to deform when said rider support is tilted in said side-to-side direction, whereby said steering biasing spring's resistance to deformation biases said vehicle to roll in a generally straight line in the absence of said side-to-side tilting of said rider support, and a throttle biasing spring constrained to deform when said rider support is tilted in said forward or backward direction, whereby said throttle biasing spring's resistance to deformation biases said vehicle to cease rolling in the absence of said forward or backward tilting of said rider support.

8. A weight-controlled vehicle, comprising:

a rider support for carrying a rider, at least three wheels mounted below said rider support for carrying said rider support and for enabling said vehicle to roll when placed upon a riding surface, said wheels being spaced to stably support said vehicle in a statically stable mode to normally prevent said vehicle from tipping when placed upon said riding surface, a motor and a power transmission for rotating at least one of said wheels and for propelling said vehicle along said riding surface, a speed control coupling attaching said rider support to lower components of said vehicle and arranged to enable said rider support to tilt relative to said lower components, such tilting occurring in a generally forward or backward direction, a speed control for enabling said rider to control the rolling speed of said vehicle in response to said forward or backward tilting of said rider support, a steering control for enabling said rider to tilt said rider support in a generally side-to-side direction and in response to such tilting, steer said vehicle to the side in which said rider support is tilted when said vehicle rolls upon said riding surface, said rider support having a seat upon which a rider may sit while operating said vehicle, whereby said rider may control the rolling speed and steered direction of said vehicle by appropriate tilting of said rider support when said rider is seated in said seat upon said rider support.

9. The vehicle of claim 8 wherein said speed control includes:

a rolling direction reverser for enabling said motor to propel said vehicle forward when said rider support is tilted into the forward range of its tilting motion and backward when said rider support is tilted into the rearward range of its tilting motion, whereby the direction that said vehicle rolls may be reversed in response to said forward or backward tilting of said rider support.

10. The vehicle of claim 8, further including:

at least one handlebar for stabilizing said rider while said rider is situated on said rider support, said handlebar being removable from said vehicle for enabling said rider to operate said vehicle with hands free and to operate and store said vehicle with reduced encumbrance from said handlebar.

11. The vehicle of claim 8, further including:

at least one handlebar for stabilizing said rider while said rider is situated on said rider support, and a clamping articulation for tucking said handlebar to a lower, less obtrusive position for enabling said rider to operate said vehicle with hands free and to operate and store said vehicle with reduced encumbrance from said handlebar.

12. A weight-controlled vehicle, comprising:

rider support means for supporting the body of a rider, at least three wheels enabling said vehicle to roll when placed upon a riding surface, said wheels being spaced to stably support said vehicle in a statically stable mode to normally prevent said vehicle from tipping when placed upon said riding surface, propulsion means for propelling said vehicle along said riding surface, speed control attaching means for attaching said rider support means to lower components of said vehicle and arranged to enable said rider support means to tilt relative to said lower components, such tilting occurring in a generally forward or backward direction, speed control means for enabling said rider to control the rolling speed of said vehicle in response to said forward or backward tilting of said rider support means, steering control tilting means for enabling said rider to tilt said rider support means in a generally side-to-side direction and in response to such tilting, steer said vehicle to the side in which said rider support means is tilted when said vehicle rolls upon said riding surface, said rider support means having an upward facing area of an appropriate size and shape to enable operation of said vehicle by a rider situated upon said rider support means in a standing, sitting, or kneeling riding position, said upward facing area being generally free of upwardly extending protrusions which would otherwise substantially inhibit said rider from operating said vehicle in any of said riding positions, whereby said rider may control the rolling speed and steered direction of said vehicle by appropriate tilting of said rider support means when said rider is situated upon said rider support means in any of said riding positions.

13. The vehicle of claim 12 wherein said speed control means includes:

a rolling direction reversing means for enabling said propulsion means to propel said vehicle forward when said rider support means is tilted into the forward range of its tilting motion and backward when said rider support means is tilted into the rearward range of its tilting motion, whereby the direction that said vehicle rolls may be reversed in response to said forward or backward tilting of said rider support means.

14. The vehicle of claim 12, further including:

an upwardly extending support means with at least one hand grip area for said rider to hold on to and for facilitating the balance of said rider while said rider is situated on said rider support means, said upwardly extending support means being removable from said vehicle for enabling said rider to optionally operate said vehicle with hands free and to operate and store said vehicle with reduced encumbrance from said upwardly extending support means.

15. The vehicle of claim 12, further including:

an upwardly extending support means with at least one hand grip area for said rider to hold on to and for facilitating the balance of said rider while said rider is situated on said rider support means, a clamping articulation means for tucking said upwardly extending support means to a lower, less obtrusive position and for enabling said rider to operate said vehicle with hands free and to operate and store said vehicle with reduced encumbrance from said upwardly extending support means.

16. The vehicle of claim 12, further including:

a steerable wheel mounting means attached below said rider support means by a steering union means for enabling said steerable wheel mounting means to pivot along a steering axis, at least two of said wheels being truck wheels rotatably attached to the left and right extremities of said steerable wheel mounting means and spaced to normally prevent said vehicle from tipping in a side-to-side direction, said steering axis generally falling within a left-right facing plane and also being substantially inclined to translate said side-to-side tilting of said rider support means into appropriate left or right turning motion of said steerable wheel mounting means for causing said truck wheels to steer said vehicle to the left or right in response to said side-to-side tilting of said rider support means, at least one said remaining wheel being a drive wheel rotationally coupled to said propulsion means for propelling said vehicle along said riding surface, said drive wheel being located substantially in front or behind said truck wheels to prevent said vehicle from tipping in a front-to-back direction.

17. The vehicle of claim 12 wherein at least one of said wheels is a drive wheel and further including:

a steerable wheel mounting means attached below said rider support means by a steering union means for enabling said steerable wheel mounting means to turn to the left or right, a steering linking means coupling said rider support means to said steerable wheel mounting means for turning said steerable wheel mounting means to the left or right in response to said side-to-side tilting of said rider support means, said drive wheel being mounted to said steerable wheel mounting means for steering said vehicle to the left or right when said steerable wheel mounting means turns to the left or right in response to said side-to-side tilting of said rider support means, said propulsion means also being mounted to said steerable wheel mounting means and rotationally coupled to said drive wheel for propelling said vehicle along said riding surface.

18. The vehicle of claim 12, further including:

steering biasing means for causing said vehicle to roll in a generally straight line in the absence of said side-to-side tilting of said rider support means, and throttle biasing means for causing said vehicle to cease rolling in the absence of said forward or backward tilting of said rider support means.

19. An apparatus, comprising:

a plurality of at least three motive structures contacting a surface with said motive structures disposed in a non-linear arrangement;

a motive source, coupled to at least one motive structure, for moving said at least one motive structure to translate the apparatus in both a first direction over said surface and in a directly opposed second direction over said surface;

a steering control for setting said first direction; and a rider platform, moveably coupled to said motive structures and having at least two orthogonal axes of motion relative to said motive structures including a pitch attitude motion and a roll attitude motion wherein said steering control is responsive to said roll attitude motion and wherein said motive source is responsive to said pitch attitude motion;

and wherein said pitch attitude motion includes a user defined variable rotation about a pitch axis wherein said pitch axis is disposed between a foremost motive structure and a rearmost motive structure and wherein a magnitude of said motive source response is directly related to a magnitude of said pitch attitude motion set by said user.

20. The apparatus of claim 19 wherein said non-linear arrangement includes generally an isosceles triangle having three vertices with one of said motive structures at each said vertex.

21. The apparatus of claim 20 wherein said triangle includes a first side and a second side of equal length to said first side with a particular one vertex at a point of intersection of said first side and second side wherein said motive structure at said particular one vertex coupled to said steering control effects said first direction.

22. The apparatus of claim 21 wherein said motive structure at said particular one vertex rotates about an axis perpendicular to said first direction and perpendicular to a plane containing a rider surface of said rider platform when moving in said first direction and wherein said steering control rotates said axis relative to said rider platform to effect said first direction.

23. An apparatus, comprising:

no more than three wheels contacting a surface with said wheels disposed in a triangular arrangement having a particular one vertex of said triangular arrangement being a forward-most vertex and a particular one wheel located at said forward-most vertex being a steering wheel;

a motive source, coupled to at least one wheel, for moving the apparatus in both a first direction over said surface and in a directly opposed second direction over said surface by rotating said at least one wheel in a first rotation for said first direction and rotating said at least one wheel in a second rotation for said second direction;

a steering control, coupled to said steering wheel, for setting said first direction; and a generally planar rider platform, pivotally coupled to said motive structures and extending an entire length of the apparatus, said rider platform having at least two orthogonal axes of motion relative to said wheels including a pitch attitude and a roll attitude wherein said steering control is responsive to said roll attitude to set said first direction and said second direction and wherein said motive source is responsive to said pitch attitude to move the apparatus forward in said first direction and backward in said second direction with a forward velocity and a backward velocity responsive to a magnitude of pitch deviation from a neutral position.

24. A method of operating an apparatus, the method comprising:

a) pitching a rider platform forward from a neutral position to a forward pitched angle, said rider platform pivotably coupled to a plurality of structures supporting said rider platform above a surface wherein a forward speed of the rider platform in a forward direction over said surface is directly related to a magnitude of said forward pitched angle; and b) pitching said rider platform backward from said neutral position to a backward pitched angle wherein a backward speed of said rider platform in a backward direction over said surface is directly related to a magnitude of said backward pitched angle; and c) rolling said rider platform to starboard from said neutral position to a starboard pitched angle wherein a starboard turning rate of said forward direction and a port turning rate of said backward direction are directly related to a magnitude of said starboard pitched angle; and d) rolling said rider platform to port from said neutral position to a port pitched angle wherein said port turning rate of said forward direction and said starboard turning rate of said backward direction are directly related to a magnitude of said port pitched angle and wherein said rider platform is biased to said neutral position with said neutral position producing zero for said forward speed, said backward speed, said starboard turning rate and said port turning rate.

25. A method of using a vehicle for carrying a person, the method comprising:

a) assuming a position on a platform that supports the person, said platform biased to a neutral position and moveably mounted relative to a motive system including a motorized drive that propels said platform over an underlying surface through motion of at least one ground-contacting member of said motive system; and b) pitching said platform from said neutral position to variably control both a forward speed and a backward speed of said platform over said underlying surface directly responsive to a magnitude of a pitch angle of said platform relative to said motive system; and c) rolling said platform from said neutral position to variably control both a starboard turning rate and a port turning rate of said platform as it moves at said forward speed and said backward speed, said turning rates directly responsive to a magnitude of a roll angle of said platform relative to said motive system.

26. The apparatus of claim 25 wherein said roll attitude motion includes a user definable variable rotation about a roll axis wherein said roll axis is disposed between a leftmost motive structure and a rightmost motive structure and wherein a magnitude of said steering control response is directly related to a magnitude of said roll attitude motion set by said user.

* * * * *